United States Patent [19]

Keintzel et al.

[11] Patent Number: 4,708,093

[45] Date of Patent: Nov. 24, 1987

[54] APPARATUS FOR DRYING AND SUPERHEATING STEAM

[75] Inventors: Günter Keintzel, Engelskirchen; Klaus Westebbe, Gummersbach, both of Fed. Rep. of Germany

[73] Assignee: L. & C. Steinmüller GmbH, Gummersbach, Fed. Rep. of Germany

[21] Appl. No.: 876,981

[22] Filed: Jun. 19, 1986

[30] Foreign Application Priority Data

Jun. 22, 1985 [DE] Fed. Rep. of Germany ..... 3522428

[51] Int. Cl.[4] ..... F22G 1/00

[52] U.S. Cl. ..... 122/483; 55/440; 55/443; 122/491

[58] Field of Search ..... 122/459, 460, 469, 476–478, 122/483, 488, 489, 491, 511, 512; 55/440, 443, 462, 463, 464, 465

[56] References Cited

U.S. PATENT DOCUMENTS

| | | | |
|---|---|---|---|
| 3,593,500 | 7/1971 | Ritland | 122/488 X |
| 3,745,978 | 7/1973 | Armand | 122/483 |
| 3,923,010 | 12/1975 | Chlique | 122/483 |
| 4,016,835 | 4/1977 | Yarden et al. | 122/483 |
| 4,103,647 | 8/1978 | Dorling et al. | 122/483 |
| 4,246,872 | 1/1981 | Skinner et al. | 122/512 X |
| 4,250,841 | 2/1981 | Bessouat et al. | 122/483 |
| 4,485,069 | 11/1984 | Byerley | 122/483 X |
| 4,576,125 | 3/1986 | Keintzel, et al. | 122/483 |
| 4,589,893 | 5/1986 | Franzolini et al. | 122/483 X |

FOREIGN PATENT DOCUMENTS

| | | |
|---|---|---|
| 5225 | 4/1981 | European Pat. Off. . |
| 2901272 | 7/1980 | Fed. Rep. of Germany . |

*Primary Examiner*—Albert J. Makay
*Assistant Examiner*—Steven E. Warner
*Attorney, Agent, or Firm*—Becker & Becker, Inc.

[57] ABSTRACT

An apparatus for drying and superheating steam, especially for supplying steam to a turbine. The apparatus includes a horizontal cylindrical pressure tank that has at least one steam inlet, a water separator that is disposed in the lower portion of the pressure tank and extends essentially over the entire length of the tank, a superheater that is disposed in the upper portion of the pressure tank and extends essentially over the entire length of the tank, and at least one steam outlet disposed on the upper side of the tank and connected to the superheater. The steam inlet is disposed at one end face of the pressure tank. Drying steam leaves the water separator, one end of which is supplied with wet steam, and enters the pressure tank. The water separator and the superheater, as self-contained structural units independently of one another and free from any seal that extends over the entire length of the pressure tank, are held against the wall of the pressure tank or on the wall of the pressure tank in such a way as to be movable relative to one another in response to heat.

10 Claims, 5 Drawing Figures

APPARATUS FOR DRYING AND SUPERHEATING STEAM

BACKGROUND OF THE INVENTION

1. Field of the Invention

The invention relates to an apparatus for drying and superheating steam, especially for supplying steam to a turbine, with the apparatus including a horizontal cylindrical pressure tank having at least one steam inlet, a water separator that is disposed in the lower portion of the pressure tank and extends essentially over the entire length of the tank, a superheater that is disposed in the upper portion of the pressure tank, and at least one steam outlet disposed on the upper side of the tank and connected to the superheater.

2. Description of the Prior Art

An apparatus of this type is known from European Patent Application No. 0 005 225, where the two systems that are accommodated in the pressure tank, namely the water separator and the superheater, are structurally interconnected, in particular over their entire length. Due to different temperatures that exist in the two systems, the interconnection must not only be shiftable, but at the same time must also be a sealed connection in order to avoid by-pass flows. All or part of the inner surface of the pressure tank is subjected to wet steam and must for this reason be protected in an expensive manner from corrosion by being plated or by being provided with deflection plates. In the heretofore known arrangement, the water separator units are disposed parallel to the in-flowing steam. To uniformly subject the water separator units to the water in the steam, considerable resistances in the form of rectifiers must be installed, with these rectifiers causing a loss in pressure and hence a reduction of the efficiency.

Furthermore, combinations of apparatus for drying steam and for subsequent superheating are known for example from U.S. Pat. Nos. 4,103,647, 4,576,125, German Pat. No. 29 01 272 A1, U.S. Pat. No. 3,923,010 and European Patent Application No. 0 005 225 A1. For specific turbine constructions these apparatus have the drawback that the superheater, and hence the steam inlets, have to be disposed in a limited amount of space. Due to this limitation, it is necessary to have complicated steam outlet lines, resulting in pressure and heat losses.

The object of the present invention is to provide an apparatus of the type described in the inroductory portion of this disclosure, with the water separator and the superheater being independent of one another from a flow standpoint, while at the same time no greater protection against corrosion is required for the pressure tank.

SUMMARY OF THE INVENTION

This object is realized by having the steam inlet disposed at one end face of the pressure tank, with dry steam that leaves the water separator, one end of which is supplied with wet steam, entering the pressure tank; the water separator and the superheater, as self-contained structural units independently of one another and without a sealing means that extends over the entire length of the pressure tank, are held against the wall of the pressure tank or on the wall of the pressure tank in such a way as to be movable relative to one another in response to heat variations.

The two systems, namely the water separator and the superheater, are self-contained and are disposed in the tank independently of one another from a structural as well as from a flow standpoint. Since the two systems are subjected to different temperatures, no pressures or forces occur due to suppressed thermal expansion or leaks; likewise, it is not necessary to connect the systems to the wall of the pressure tank over the entire length of the apparatus. Not having such a connection eliminates the need for a displaceable sealing means. As a consequence of the self-contained systems, not only the length but also the periphery of the pressure tank are subjected to the steam having the same temperature. A banana-shaped distortion of the apparatus combination does not occur.

Thus, a connection of the self-contained structural groups to the pressure tank is effected only to secure them in such a manner that they are movable in response to heat. In particular, the superheater can comprise a plurality of subgroups and can be provided for the supply and discharge of steam.

The length of the pressure tank can conform to the length of an ND(low pressure)-turbine. This concept achieves an extremely favorable guidance for the steam outlet lines. The lines become very short, and hence the loss of pressure and heat is low.

The water separator and/or the superheater are preferably displaceably held on the wall independently of one another, since in this way the thermally-induced movements can be absorbed.

The number or scope of the mounting or support units is advantageously reduced if the superheater is displaceably suspended, since this can be effected on common brackets.

However, it is also expedient to suspend the superheaters via connecting rods and/or to displaceably support the separators. The superheater can advantageously be embodied in a multi-flow and/or multi-stage manner.

In addition, the water separator system is expediently embodied in such a way that by uniformly subjecting the water separator units to wet steam, a high rate of separation is achieved at relatively little loss in pressure, with an economically advantageous construction being achieved in conjunction with the structurally independent superheater system disposed thereabove.

BRIEF DESCRIPTION OF THE DRAWINGS

The invention will now be explained in detail with the aid of the accompanying drawings. Shown are.

DESCRIPTION OF THE PREFERRED EMBODIMENTS

Figure 1:
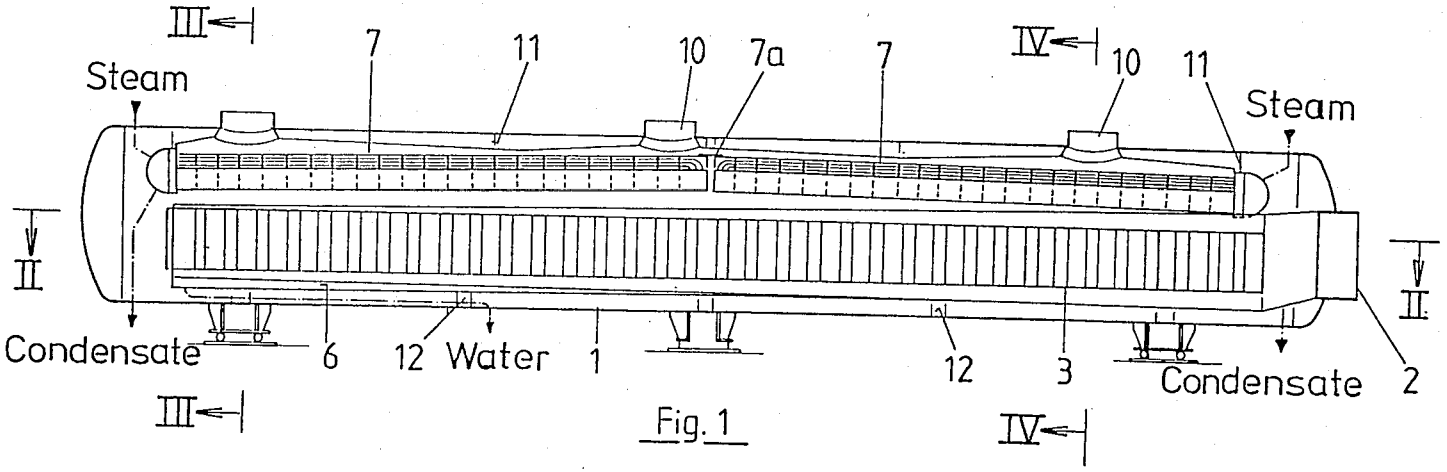
FIG. 1 a vertical cross-sectional view with a first mounting support for the separator and superheater.
Figure 2:
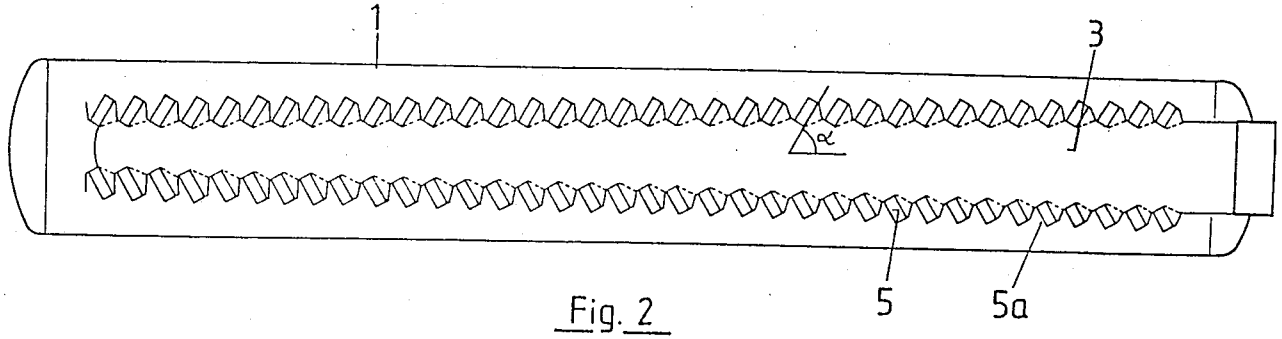
FIG. 2 a horizontal cross-sectional view of the water separator system taken along the line II—II.

The steam that has expanded in the HD high pressure portion of the turbine, and hence is wet, enters the water separator system 3 via one or more inlets 2. The separator system is formed by guide or deflection plates 4 and water separtor units 5. The separator system tapers over its entire length, starting from the inlet side. A nearly uniform contact of the water separator units 5 is achieved as a result of this tapered configuration, and as a result of the steam discharge surfaces 5*a* that are disposed at an angle $\alpha$ of 10° to 90° relative to the main direction of flow. Rectifiers in the form of louver-like plates and/or perforated plates are required only to a slight extent. The wet steam passes out of the inlet or inlets 2 directly into the interior of the separator system. As the steam passes through the water separator units 5, the steam is mechanically dried. To improve the efficiency of the water separator system, and to reduce the expenditure for uniform steam-water contact, the steam inlet velocity is reduced by appropriately dimensioning the in-flow cross-sectional area of the separator system. Splash water and/or larger drops of water precipitate out of the steam flow and are withdrawn via a separate withdrawal system 6 disposed at the lower steam deflection plate. Only now does the thus-dried steam come into contact with the pressure tank wall 1. No corrosion due to water can occur on the unplated pressure tank walls.

Disposed above the water separator system is the superheater system 7, which also extends over the entire length of the tank. The single or multi-flow and/or single or multi-stage superheater system essentially comprises the tube bundles 8, which can comprise not only U-tube but also linear tube heat exchangers. To drain the condensate that is produced during heat exchange within the tubes, the tube bundles 8 can be sloped and/or can be operated with so-called booster steam.

The steam that is superheated on the surface of the tube bundles is conveyed out of the apparatus via guide plates 9 that are connected with the pressure tank wall 1 only at the outlets 10.

Figure 3:
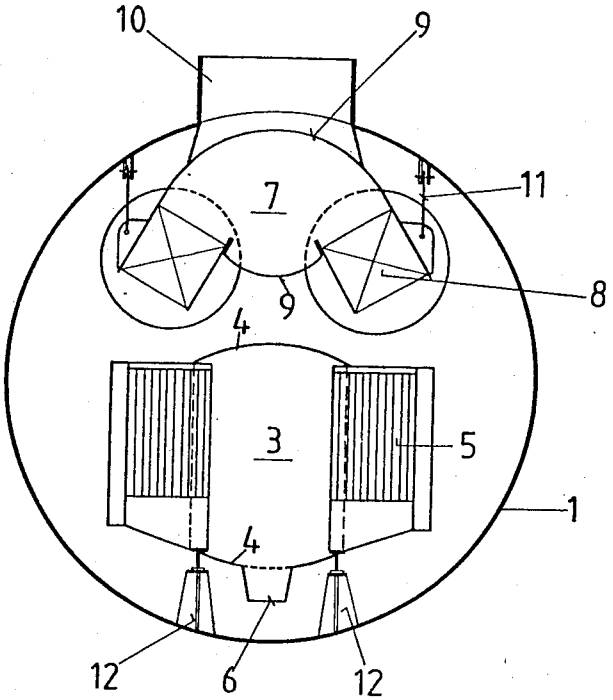
FIG. 3 is a cross-sectional view through the tank showing the first mounting support and taken along the line III—III.

As can been seen from FIGS. 1 and 3, the structural components of the superheater 7 are suspended on the pressure tank wall 1 via connecting rods 11, while the water separator 3 is slidingly supported on brackets 12 that are welded to the pressure tank wall 1.

Figure 4:
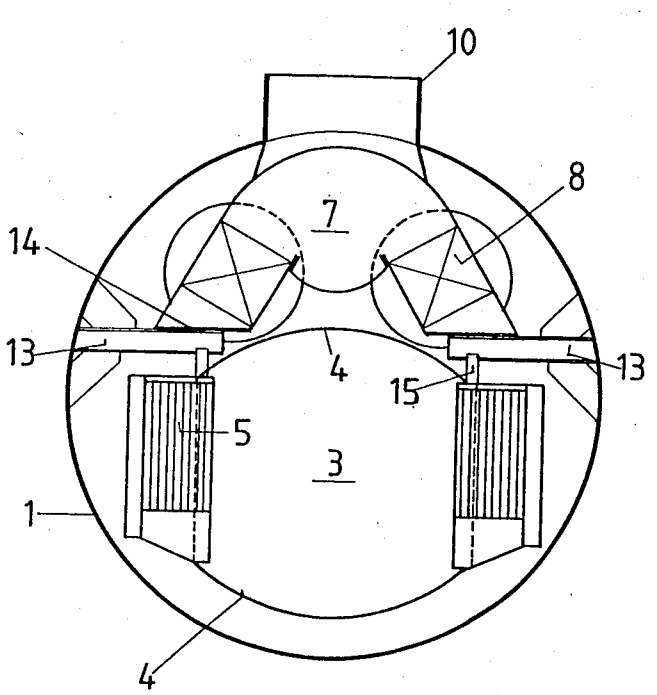
FIG. 4 a cross-sectional view of the tank showing a second mounting support and taken along the line IV—IV.

The cross-sectional view of FIG. 4 shows another embodiment for the support mechanism. Secured to the sides of the inner wall of the pressure tank 1 are cantilevers or brackets 13 in the form of an I-beam. The superheater 7 is deplaceably supported on these beams via pressure pads or guides 14, while the water separator 3 is displaceably suspended on the brackets 13 via mounting brackets 15 that engage the lower flange of the I-beam.

Figure 5:
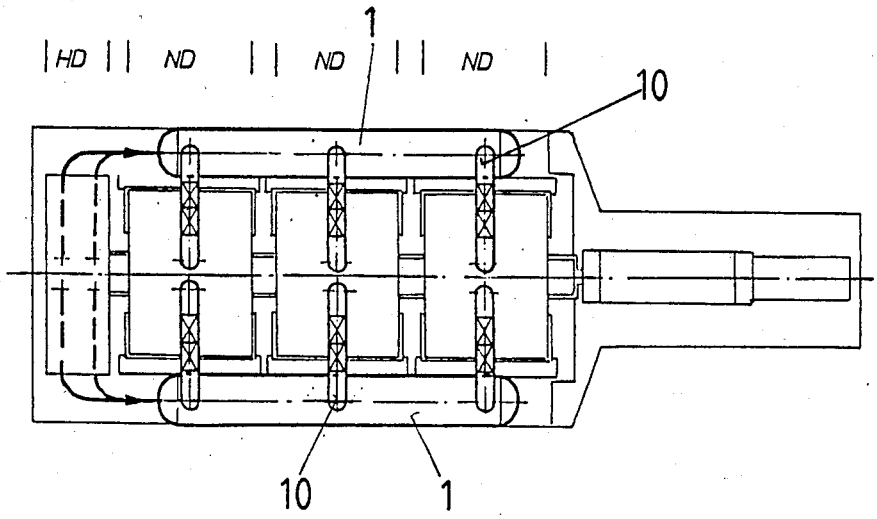
FIG. 5 a cross-sectional view of an arrangement showing two inventive apparatus in an HD-steam turbine.

FIG. 5 shows the arrangement of two apparatus in one turbine, and illustrates the short connection of the outlets 10 to the housing of the turbine.

Reference will now be made specifically to the arrangement of the individual structural groups illustrated in FIGS. 1, 3 and 4. In an embodiment pursuant to FIGS. 1, 3 and 4 having two superheater units, a resistance to flow is installed between these units, as indicated in FIG. 1 at the reference numeral *7a*.

The present invention is, of course, in no way restricted to the following specification and drawings, but also encompasses any modifications within the scope of the appended claims.

We claim:

1. In an apparatus for drying and superheating steam, especially for supplying steam to a turbine, with said apparatus including a horizontal cylindrical pressure tank having a wall and having at least one steam inlet as well as having a centerline, a water separator mechanism that is disposed in the lower portion of the pressure tank and extends essentially over the entire length of said tank, a superheater mechanism that is disposed in the upper portion of said pressure tank and extends essentially over the entire length of said tank, and at least one steam outlet disposed on the upper side of said tank and connected to said superheater mechanism so that said water separator mechanism and said superheater mechanism are embodied as structural groups and the steam discharges dried out of said water separator mechanism directly into said pressure tank and from there enters into said superheater mechanism, the improvement therewith which comprises:

said pressure tank including two end faces, with said at least one steam inlet being disposed at one of said end faces; said water separator mechanism having a predetermined shape in a direction toward the center line of the tank and having two ends, one of which is wider and receives wet steam from said steam inlet at an angle to the centerline of said tank, with said water separator mechanism being disposed in said pressure tank in such a way that dry steam leaving said water separator mechanism enters said pressure tank; said water separator mechanism and said superheater mechanism as structural groups closed in themselves each being self-contained, mounted independent of one another, and supported by said pressure tank as well as being free of any sealing means extending over the entire length of said pressure tank and being held against the wall of said pressure tank.

2. An apparatus according to claim 1, in which said pressure tank has an inner wall, with said water separator mechanism and said superheater mechanism being supported thereon.

3. An apparatus according to claim 2, with said water separator mechanism and said superheater mechanism being supported on said pressure tank wall in such a way as to be movable relative to one another in response to heat variations.

4. An apparatus according to claim 2, in which at least one of said water separator mechanism and said superheater mechanism, independently of one another, are displaceably supported on said pressurue tank wall.

5. An apparatus according to claim 4, in which said superheater mechanism is displaceably supported, and said separator mechanism is displaceably suspended.

6. An apparatus according to claim 4, in which said superheater mechanism is embodied in a multi-flow and/or multi stage manner.

7. An apparatus according to claim 4, which includes water separator units that define said water separator mechanism, with said units having steam distribution surfaces that are disposed at an angle $\alpha$ of from 10° to 90° relative to said central axis of said pressure tank.

8. An apparatus according to claim 4, in which said pressure tank and its components are embodied in such a way that steam is guided within said tank in such a way that both the entire length as well as the entire periphery of said inner wall of said pressure tank is subjected to the same temperature, thus preventing distortion of said inner tank wall due to variations in thermal stress.

9. An apparatus according to claim 4, in which said superheater mechanism is held on said pressure tank wall via connecting rods.

10. An apparatus according to claim 9, in which said separator mechanism is displaceably supported.

* * * * *